US007064737B2

(12) United States Patent
Lee et al.

(10) Patent No.: US 7,064,737 B2
(45) Date of Patent: Jun. 20, 2006

(54) METHOD OF DRIVING CHOLESTERIC LIQUID CRYSTAL DISPLAY PANEL USING ROOT-MEAN-SQUARE VOLTAGE

(75) Inventors: Nam-Seok Lee, Suwon (KR); Woon-Seop Choi, Seoul (KR); Yeon-Gon Mo, Suwon (KR); Ki-Suk Seong, Seoul (KR); Seok-Hong Jeong, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 501 days.

(21) Appl. No.: 10/273,169

(22) Filed: Oct. 18, 2002

(65) Prior Publication Data

US 2003/0122764 A1 Jul. 3, 2003

(30) Foreign Application Priority Data

Dec. 27, 2001 (KR) ..... 2001-85909

(51) Int. Cl.
*G09G 3/36* (2006.01)

(52) U.S. Cl. ..... 345/94; 345/95; 345/210

(58) Field of Classification Search ..... 345/87, 345/94, 95, 204, 208–210, 690; 149/169; 349/169

See application file for complete search history.

(56) References Cited

U.S. PATENT DOCUMENTS 5,748,277 A 5/1998 Huang et al.
6,154,190 A 11/2000 Yang et al.
6,731,261 B1 * 5/2004 Schlangen et al. ..... 345/95

* cited by examiner

*Primary Examiner*—Regina Liang
(74) *Attorney, Agent, or Firm*—Robert E. Bushnell, Esq.

(57) ABSTRACT

A method of driving a cholesteric liquid crystal display (LCD) panel by applying at least first, second, and third voltages to cholesteric liquid crystal cells of the cholesteric LCD panel is provided. The method includes alternately applying the first and second voltages to apply the third voltage, which is given by the root-mean-square value of the first and second voltages, to the cholesteric liquid crystal cells.

19 Claims, 6 Drawing Sheets

METHOD OF DRIVING CHOLESTERIC LIQUID CRYSTAL DISPLAY PANEL USING ROOT-MEAN-SQUARE VOLTAGE

CLAIM OF PRIORITY

This application makes reference to, incorporates the same herein, and claims all benefits accruing under 35 U.S.C. §119 from my application entitled METHOD FOR DRIVING CHOLESTRIC LIQUID CRYSTAL DISPLAY PANEL UTILIZING ROOT-MEAN-SQUARE VOLTAGE earlier filed with the Korean Industrial Property Office on 27 Dec. 2001 and there duly assigned Ser. No. 2001-85909.

BACKGROUND OF THE INVENTION

1. Field of the Invention

The present invention relates to a method of driving a cholesteric liquid crystal display (LCD) panel, and more particularly, to a method of driving a cholesteric LCD panel by applying at least first, second, and third voltages to cholesteric liquid crystal cells of the cholesteric LCD panel.

2. Description of the Related Art

Cholesteric LCD panels are reflective LCD panels having a structure in which cholesteric liquid crystal is filled among transparent electrode lines formed of, for example, indium-tin-oxide (ITO), which are arranged on two transparent substrates, for example, glass substrates, facing each other.

The fundamental characteristics of a cholesteric liquid crystal cell is shown below. When a voltage higher than a first threshold voltage is applied to a cholesteric liquid crystal cell, the cholesteric liquid crystal cell changes into a homeotropic state. In the homeotropic state, molecules of the cell are vertically arranged with respect to the surface of the cell.

When the voltage, which is lower than the first threshold voltage and is higher than a second threshold voltage, is applied to the cholesteric liquid crystal cell in the homeotropic state, specifically, when the voltage that is applied to the cell in the homeotropic state is gradually lowered, the cell changes from the homeotropic state into a focal conic state. In the focal conic state, the molecules of the cell are arranged in a helical structure, and a helical axis is nearly parallel to the surface of the cell. Accordingly, light is mostly transmitted without being reflected so that the cell is almost transparent.

When the voltage, lower than the second threshold voltage, is applied to the cholesteric liquid crystal cell in the homeotropic state, specifically, when the voltage that is applied to the cell in the homeotropic state is rapidly lowered, the cell changes from the homeotropic state via a transient planar state and incomplete-planar state into a planar state. In the planar state, the molecules of the cell have a periodic helical structure, and a helical axis is perpendicular to the surface of the cell. Accordingly, only light having a wavelength corresponding to the product nP of an average refractive index "n" of the cholesteric liquid crystal cell and a helical pitch P can be reflected. Meanwhile, the transient-planar state has a similar structure to the planar state and has about twice longer helical pitch than the planar state. The incomplete-planar state is a variable state appearing in the middle of relaxation from the transient-planar state into the planar state.

The focal conic state and the planar state have a memory effect through which the states are maintained for a long period of time even if supply of voltage is stopped. Due to such memory effect produced by bistability, the planar state and the focal conic state are employed depending on selection of a certain cholesteric liquid crystal cell in cholesteric LCD panels, thereby decreasing power consumption. In addition, since cholesteric LCD panels use a selective reflection driving scheme due to their characteristics, they have a high luminance characteristic.

Exemplars in the art include U.S. Pat. No. 5,748,277 issued to Huang et al. for "Dynamic Drive Method and Apparatus for a Bistable Liquid Crystal Display," and U.S. Pat. No. 6,154,190 issued to Yang et al. for "Dynamic Drive Methods and Apparatus for a Bistable Liquid Crystal Display.

I have found that in the art, the internal circuit of the scan-electrode driving device is complicated, thereby increasing manufacturing costs.

SUMMARY OF THE INVENTION

It is therefore, an object of the present invention to provide a method of driving a cholesteric liquid crystal display (LCD) panel, through which the number of output voltage levels of a scan-electrode driving device is minimized, thereby simplifying the internal circuit of the scan-electrode driving device and reducing manufacturing costs.

It is another object to provide a technique of driving a liquid crystal display panel that increases the applicable range of the driving voltage.

It is yet another object to provide a technique of driving a liquid crystal display panel that minimizes crosstalk.

To achieve the above and other objects, the present invention provides a method of driving a cholesteric LCD panel by applying at least first, second, and third voltages to cholesteric liquid crystal cells of the cholesteric LCD panel. The method includes alternately applying the first and second voltages to apply the third voltage, which is given by the root-mean-square value of the first and second voltages, to the cholesteric liquid crystal cells.

According to the method of the present invention, the third voltage is generated using the first and second voltages. Accordingly, the number of output voltage levels of the scan-electrode driving device can be minimized, thereby simplifying the internal circuit of the device and decreasing the manufacturing costs.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
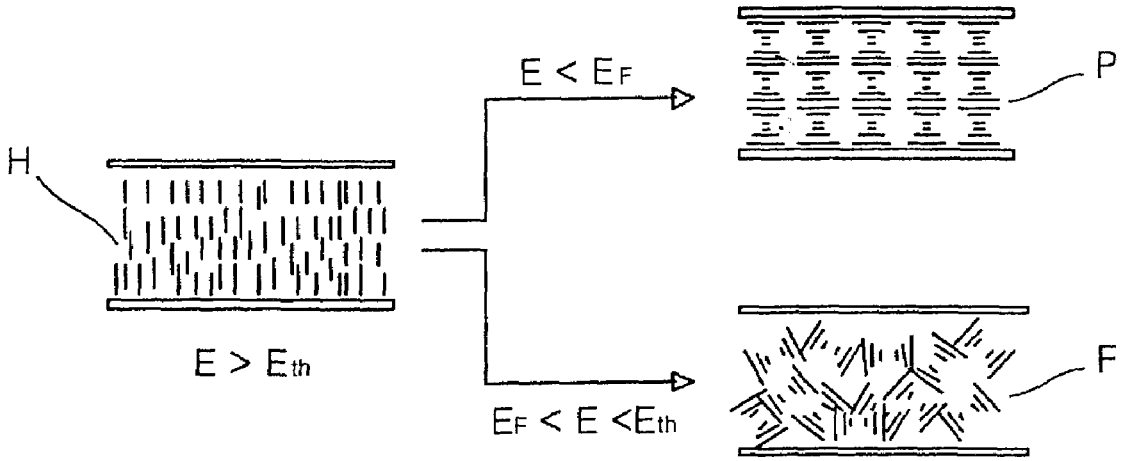
FIG. 1 (RELATED ART)
FIG. 1 shows the fundamental characteristics of a cholesteric liquid crystal cell.

FIG. 1 shows the fundamental characteristics of a cholesteric liquid crystal cell. Referring to FIG. 1, when a voltage E higher than a first threshold voltage $E_{th}$ is applied to a cholesteric liquid crystal cell, the cholesteric liquid crystal cell changes into a homeotropic state H. In the homeotropic state H, molecules of the cell are vertically arranged with respect to the surface of the cell.

When the voltage E, which is lower than the first threshold voltage $E_{th}$ and is higher than a second threshold voltage $E_F$, is applied to the cholesteric liquid crystal cell in the homeotropic state H, specifically, when the voltage E that is applied to the cell in the homeotropic state H is gradually lowered, the cell changes from the homeotropic state H into a focal conic state F. In the focal conic state F, the molecules of the cell are arranged in a helical structure, and a helical axis is nearly parallel to the surface of the cell. Accordingly, light is mostly transmitted without being reflected so that the cell is almost transparent.

When the voltage E, lower than the second threshold voltage $E_F$, is applied to the cholesteric liquid crystal cell in the homeotropic state H, specifically, when the voltage E that is applied to the cell in the homeotropic state H is rapidly lowered, the cell changes from the homeotropic state H via a transient planar state and incomplete-planar state into a planar state P. In the planar state P, the molecules of the cell have a periodic helical structure, and a helical axis is perpendicular to the surface of the cell. Accordingly, only light having a wavelength corresponding to the product nP of an average refractive index "n" of the cholesteric liquid crystal cell and a helical pitch P can be reflected. Meanwhile, the transient-planar state has a similar structure to the planar state P and has about twice longer helical pitch than the planar state P. The incomplete-planar state is a variable state appearing in the middle of relaxation from the transient-planar state into the planar state P.

The focal conic state F and the planar state P have a memory effect through which the states are maintained for a long period of time even if supply of voltage is stopped. Due to such memory effect produced by bistability, the planar state P and the focal conic state F are employed depending on selection of a certain cholesteric liquid crystal cell in cholesteric LCD panels, thereby decreasing power consumption. In addition, since cholesteric LCD panels use a selective reflection driving scheme due to their characteristics, they have a high luminance characteristic.

Figure 2:
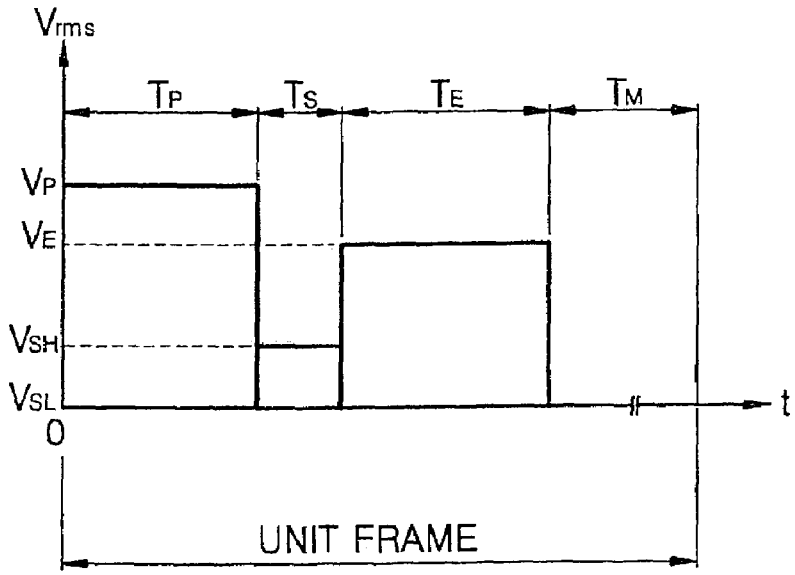
FIG. 2 (RELATED ART)
FIG. 2 is a conceptual timing diagram for explaining a typical dynamic driving method for a cholesteric liquid crystal display (LCD) panel.

FIG. 2 is a conceptual timing diagram for explaining a typical dynamic driving method for a cholesteric LCD panel. A dynamic driving method having certain features related to the dynamic driving method shown in FIG. 2, is described in detail in U.S. Pat. No. 5,748,277 issued to Huang et al. for "Dynamic Drive Method and Apparatus for a Bistable Liquid Crystal Display," and U.S. Pat. No. 6,154,190 issued to Yang et al. for "Dynamic Drive Methods and Apparatus for a Bistable Liquid Crystal Display." Referring to FIG. 2, a unit frame, which is applied to each row electrode line, i.e., each scan electrode line, includes a preparation time $T_P$, a selection time $T_S$, an evolution time $T_E$, and a maintenance $T_M$.

During the preparation time $T_P$, a preparation cell voltage $V_P$, i.e., a first voltage, is applied to all cholesteric liquid crystal cells of a cholesteric LCD panel, thereby changing all of the cholesteric liquid crystal cells into the homeotropic state H shown in FIG. 1. During the selection time $T_S$, a selection cell voltage $V_{SH}$, i.e., a second voltage, which is lower than the first voltage $V_P$, is applied to cholesteric liquid crystal cells that are turned on so that the cholesteric liquid crystal cells are maintained in the homeotropic state H, and simultaneously, a selection cell voltage $V_{SL}$, i.e., a third voltage, which is lower than the second voltage $V_{SH}$, is applied to cholesteric liquid crystal cells that are turned off so that the cholesteric liquid crystal cells change into a transient-planar state. During the evolution time $T_E$, an evolution cell voltage $V_E$, i.e., a fourth voltage, which is lower than the first voltage $V_P$ and is higher than the second voltage $V_{SH}$, is applied to all of the cholesteric liquid crystal cells so that the cholesteric liquid crystal cells that have been turned on are maintained in the homeotropic state, and simultaneously the cholesteric liquid crystal cells that have been turned off change into the focal conic state F shown in FIG. 1. During the maintenance $T_M$, a maintenance cell voltage equal to the third voltage $V_{SL}$ is applied to all of the cholesteric liquid crystal cells so that the cholesteric liquid crystal cells that have been turned on change into the planar state P shown in FIG. 1, and simultaneously the cholesteric liquid crystal cells that have been turned off are maintained in the focal conic state F. Accordingly, the cholesteric liquid crystal cells in the on-state reflect light having a wavelength corresponding to the product nP of an average refractive index "n" and a helical pitch P. However, the cholesteric liquid crystal cells in the off-state transmit most of the light in an almost transparent state.

According to the above-described conventional method of driving a cholesteric LCD panel, it is necessary to remove a mean direct current (DC) voltage in order to prevent the physical properties of liquid crystal from changing, so output voltage having at least 7 levels is required for a scan-electrode driving device. Therefore, the internal circuit of the scan-electrode driving device is complicated, thereby increasing manufacturing costs.

Figure 3:
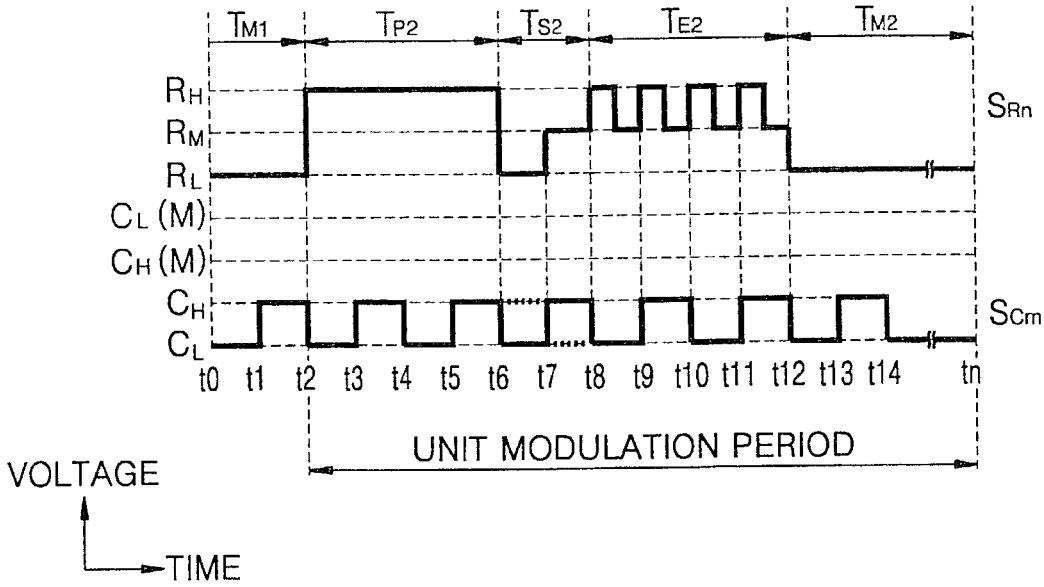
FIG. 3 is a timing diagram for explaining a method of dynamically driving a cholesteric LCD panel according to an embodiment of the present invention.
Figure 4:
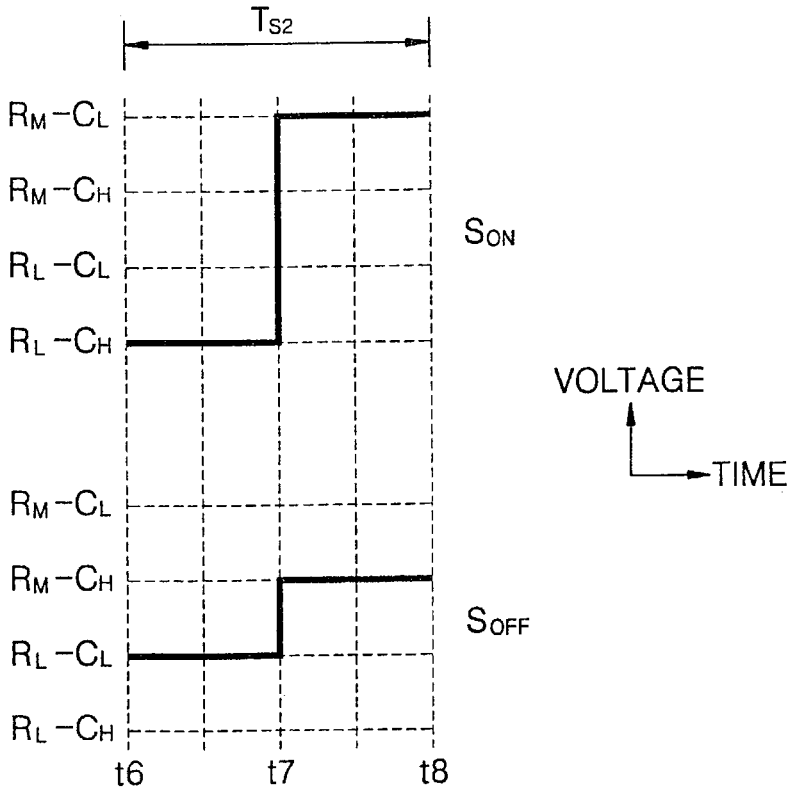
FIG. 4 is a diagram showing the waveform of a voltage which is applied to cholesteric liquid crystal cell that are turned on and the waveform of a voltage which is applied to cholesteric liquid crystal cell that are turned off, during a selection time shown in FIG. 3.

FIG. 3 shows a method of dynamically driving a cholesteric liquid crystal display (LCD) panel according to an embodiment of the present invention. In FIG. 3, a reference character $S_{Rn}$ denotes a driving signal applied to an n-th scan electrode line, a reference character $S_{Cm}$ denotes a data signal applied to an m-th data electrode line, and a reference character $T_{Ml}$ denotes a maintenance time in the previous modulation period. FIG. 4 shows the waveform of a voltage which is applied to a cholesteric liquid crystal cell that is turned on and the waveform of a voltage which is applied to cholesteric liquid crystal cell that is turned off, during a selection time shown in FIG. 3. In FIG. 4, a reference character $S_{ON}$ denotes a voltage applied to a cholesteric liquid crystal cell that is to be turned on, and a reference character $S_{OFF}$ denotes a voltage applied to a cholesteric liquid crystal cell that is to be turned off. Referring to FIGS. 3 and 4, in a method of dynamically driving a cholesteric LCD panel according to the present invention, a unit modulation period, which is applied to each row electrode line, that is, each scan electrode line, includes a preparation time $T_{P2}$, a selection time $T_{S2}$, an evolution time $T_{E2}$, and a maintenance time $T_{M2}$.

During the preparation time $T_{P2}$, a preparation line voltage $R_H$ is applied to the n-th scan electrode line of the cholesteric LCD panel so that all cholesteric liquid crystal cells of the n-th scan electrode line change into the homeotropic state H shown in FIG. 1. A preparation cell voltage, i.e., a first voltage, which is applied to all of the cholesteric liquid crystal cells of the n-th scan electrode line during the preparation time $T_{P2}$, is determined by data signals $C_H$<->$C_L$ (see FIG. 8), which are applied to data electrode lines during selection times for other scan electrode lines. This phenomenon is referred to as crosstalk, which inevitably occurs while driving a matrix LCD panel. However, as will be described to explain the selection time $T_{S2}$ below, in the present invention, data signals are applied to all data electrode lines together with signals in opposite logic states to the data signals so that crosstalk can be minimized.

The selection time $T_{S2}$ is divided into a first part time t6–t7 and a second part time t7–t8. During the second part time t7–t8, data signals are applied to all data electrode lines of the cholesteric LCD panel. During the first part time t6–t7, signals in opposite logic states to the respective data signals are applied to all of the data electrode lines.

More specifically, during the first part time t6–t7, a low selection line voltage $R_L$ is applied to the n-th scan electrode line. Simultaneously, a high data voltage $C_H$ is applied to data electrode lines that are turned on, and a low data voltage $C_L$ is applied to data electrode lines that are turned off. Here, since the high data voltage $C_H$ is higher than the low selection line voltage $R_L$, a negative voltage having a level corresponding to the difference ($R_L$–$C_H$) therebetween is applied to the cholesteric liquid crystal cells that are turned on. In the meantime, a differential voltage ($R_L$–$C_L$) between the low selection line voltage $R_L$ and the low data voltage $C_L$ is applied to the cholesteric liquid crystal cells that are turned off. Here, since the low selection line voltage $R_L$ and the low data voltage $C_L$ have the same level, voltage is not applied to the cholesteric liquid crystal cells that are turned off.

During the second part time t7–t8, a high selection line voltage $R_M$ is applied to the n-th scan electrode line. Simultaneously, the low data voltage $C_L$ is applied to the data electrode lines that are turned on, and the high data voltage $C_H$ is applied to the data electrode lines that are turned off. That is, a high positive voltage, which has a level corresponding to the difference ($R_M$–$C_L$) between the high selection line voltage $R_M$ and the low data voltage $C_L$, is applied to the cholesteric liquid crystal cells that are turned on. In the meantime, a low positive voltage, which has a level corresponding to the difference ($R_M$–$C_H$) between the high selection line voltage $R_M$ and the high data voltage $C_H$, is applied to the cholesteric liquid crystal cells that are turned off. Accordingly, the cholesteric liquid crystal cells that are turned on are maintained in the homeotropic state H, but the cholesteric liquid crystal cells that are turned off relax into the transient-planar state.

The following description concerns the influence of the first part time t6–t7 on the second part time t7–t8. In case of the cholesteric liquid crystal cells that are turned on, the negative voltage ($R_L$–$C_H$) is applied during the first part time t6–t7, and then the positive voltage ($R_M$–$C_L$) is applied during the second part time t7–t8 so that the applicable range of the positive voltage ($R_M$–$C_L$) can be increased during the second part time t7–t8. More specifically, the negative voltage ($R_L$–$C_H$), which is applied to the cholesteric liquid crystal cells that are turned on during the first part time t6–t7, prevents the cholesteric liquid crystal cells from relaxing into the transient-planar state. Accordingly, the cholesteric liquid crystal cells that are turned on can be stably maintained in the homeotropic state H during the second part time t7–t8 with a relatively low voltage so that the applicable range of the positive voltage ($R_M$–$C_L$) can be increased during the second part time t7–t8. In case of the cholesteric liquid crystal cells that are turned off, the voltage ($R_L$–$C_L$) applied during the first part time t6–t7 is 0 V, so the cholesteric liquid crystal cells that are turned off change into a very free state. Accordingly, the degree of relaxation into the transient-planar state can be increased during the second part time t7–t8 so that the cholesteric liquid crystal cells that are turned off can change into the more stable focal conic state F shown in FIG. 1 during the evolution time $T_{E2}$. In other words, the applicable range of the positive voltage ($R_M$–$C_H$) can be increased during the second part time t7–t8.

During the evolution time $T_{E2}$, the preparation line voltage $R_H$ and the high selection line voltage $R_M$ are alternately applied to the n-th scan electrode line so that root-mean-square (RMS) voltage of the two voltages $R_H$ and $R_M$, i.e., a fourth voltage $\sqrt{R_H^2+R_M^2}$, is applied to all cholesteric liquid crystal cells of the n-th scan electrode line. Accordingly, while the cholesteric liquid crystal cells that are turned on maintain the homeotropic state H, the cholesteric liquid crystal cells that are turned off change into the focal conic state F. Here, as described above, the data signals are applied to all data electrode lines together with the signals in opposite logic states to the respective data signals so that crosstalk can be minimized. In the meantime, a time t8–t9, t9–t10, t10–t11, or t11–t12 during which the preparation line voltage $R_H$ and the high selection line voltage $R_M$ are sequentially applied to all cholesteric liquid crystal cells is as long as half t6–t7 or t7–t8 of the selection time $T_{S2}$.

As described above, during the evolution time $T_{E2}$, the preparation line voltage $R_H$ and the high selection line voltage $R_M$ are alternately applied to the n-th scan electrode line so that the fourth voltage $\sqrt{R_H^2+R_M^2}$ is applied to all cholesteric liquid crystal cells of the n-th scan electrode line.

Accordingly, the number of output voltage levels of a scan-electrode driving device can be reduced to 3, thereby simplifying the internal circuit of the device and decreasing the manufacturing costs.

During the maintenance time $T_{M2}$, a voltage equal to the low selection line voltage $R_L$ is applied to the n-th scan electrode line so that the cholesteric liquid crystal cells in the on state change into the planar state P shown in FIG. 1 while the cholesteric liquid crystal cells in the off state maintain the focal state F. Accordingly, the cholesteric liquid crystal cells in the on state reflect light having a wavelength corresponding to the product nP of an average refractive index "n" and a helical pitch P. However, the cholesteric liquid crystal cells in the off state transmit light in an almost transparent state. Here, as described above, the data signals are applied to all data electrode lines together with the signals in opposite logic states to the respective data signals so that crosstalk can be minimized.

Meanwhile, when the polarity of a driving voltage applied to all cholesteric liquid crystal cells is inverted with a unit modulation period, a mean direct current (DC) voltage can be removed, thereby preventing the physical properties of cholesteric liquid crystal from changing. In another embodiment of the present invention, the polarity of a driving voltage applied to all cholesteric liquid crystal cells can be inverted with a unit modulation period without using an extra negative voltage. More specifically, for the data signal $S_{Cm}$, a voltage $C_L(M)$ having a level equal to the preparation line voltage $R_H$, e.g., 32 V (volts), is used instead of the low data voltage $C_L$, e.g., 0 V, and a voltage $C_H(M)$ having a level of $C_L(M)$-$C_H$, e.g., 27 V, is used instead of the high data voltage $C_H$, e.g., 5 V. In addition, for the scan signal $S_{Rn}$, while the high selection line voltage $R_M$ is maintained, the preparation line voltage $R_H$ and the low selection line voltage $R_L$ are in opposition to each other in two consecutive unit modulation periods. For example, in a case where inversion driving is performed with a unit modulation period, during the maintenance time $T_{Ml}$ in previous unit modulation period, a high maintenance line voltage $R_H$ is applied to the n-th scan electrode line, while the voltages $C_L(M)$ and $C_H(M)$ resulting from crosstalk are applied to the m-th data electrode line. During such inversion driving, only the polarity of a driving voltage applied to all cholesteric liquid crystal cells changes, and the operations are the same as those described above.

Figure 5:
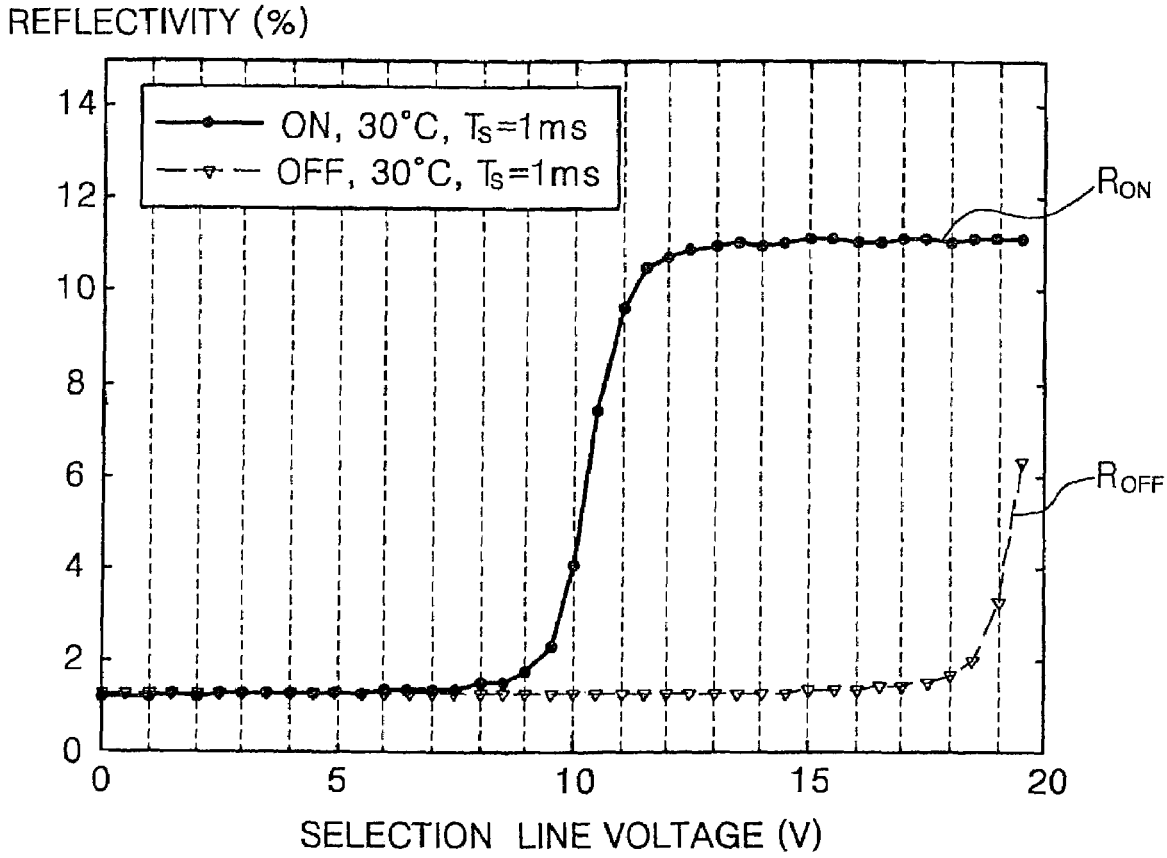
FIG. 5 is a graph of the reflectivity of cholesteric liquid crystal cells versus a selection line voltage, which is applied to a scan electrode line during a second part time shown in FIG. 3.

FIG. 5 is a graph of the reflectivity of cholesteric liquid crystal cells versus the high selection line voltage $R_M$, which is applied to a scan electrode line during the second part time t7–t8 shown in FIG. 3. In FIG. 5, a reference character $R_{ON}$ denotes a characteristic curve of a cholesteric liquid crystal cell that is turned on during the first part time t6–t7 when an ambient temperature is 30° C. (Celsius) and the selection time $T_{S2}$ is 1 milliseconds (ms), and a reference character $R_{OFF}$ denotes a characteristic curve of a cholesteric liquid crystal cell that is turned off during the first part time t6–t7 when an ambient temperature is 30° C. (Celsius) and the selection time $T_{S2}$ is 1 milliseconds (ms). In FIG. 5, Referring to FIG. 5, the cholesteric liquid crystal cell in the on state changes into the planar state P shown in FIG. 1 at about 10 V. The cholesteric liquid crystal cell in the off state changes into the planar state P at about 20 V. Accordingly, a difference of about 10 V occurs. However, it can be seen that it is satisfactory that the difference between the voltage ($R_M$–$C_L$) applied to cholesteric liquid crystal cells in the on state and the voltage ($R_M$–$C_H$) applied to cholesteric liquid crystal cells in the off state is about 5.5 V during the second part time t7–t8. In other words, due to the existence of the first part time t6–t7, the applicable range of a driving voltage is increased during the second part time t7–t8.

Figure 6:
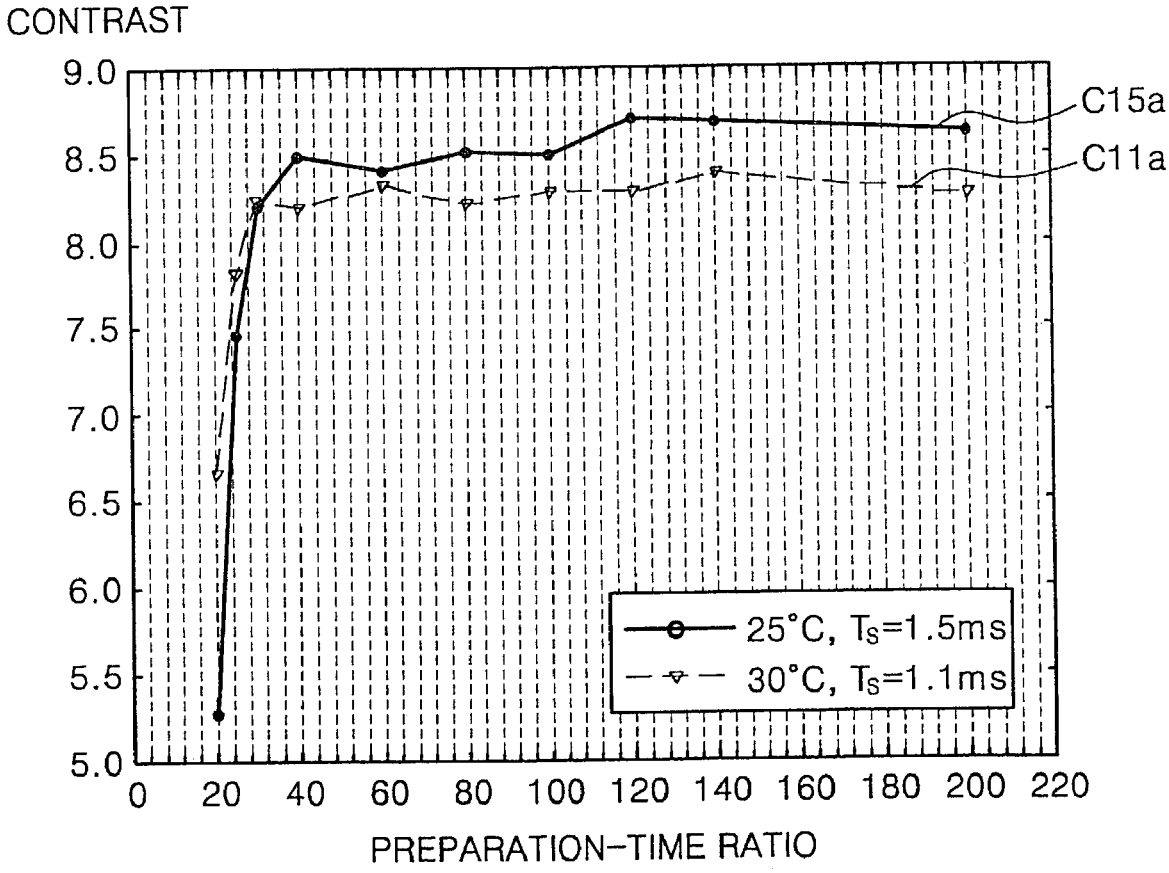
FIG. 6 is a graph of the contrast of a cholesteric LCD panel versus a preparation-time ratio.

FIG. 6 is a graph of the contrast of a cholesteric LCD panel versus a preparation-time ratio. Here, the preparation-time ratio indicates a ratio of the preparation time $T_{P2}$ shown in FIG. 3 to the selection time $T_{S2}$ shown in FIG. 3. In FIG. 6, a reference character C15*a* denotes the characteristic curve when an ambient temperature is 25° C. (Celsius) and the selection time $T_{S2}$ is 1.5 milliseconds (ms), and a reference character C11*a* denotes the characteristic curve when an ambient temperature is 30° C. and the selection time $T_{S2}$ is 1.1 ms. Referring to FIG. 6, the contrast can be enhanced when the preparation time $T_{P2}$ is 40 times longer than the selection time $T_{S2}$.

Figure 7:
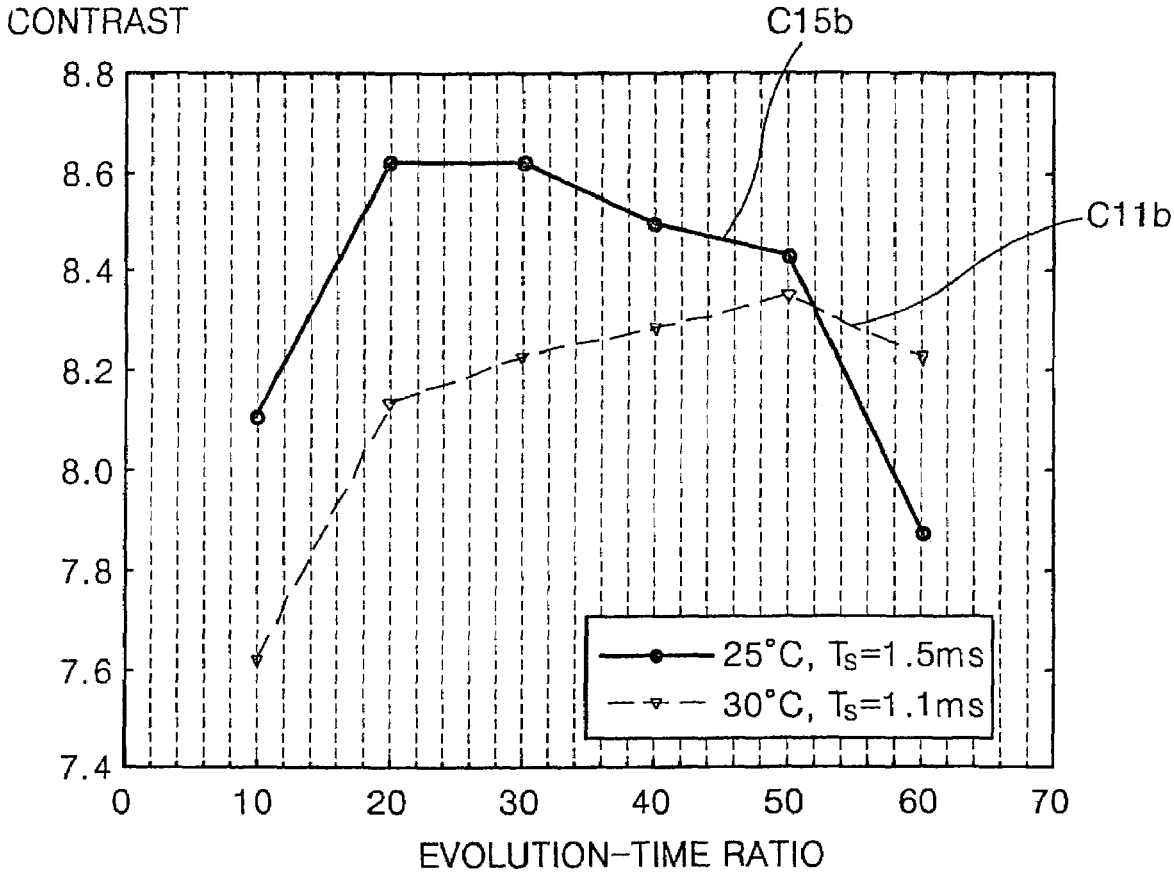
FIG. 7 is a graph of the contrast of a cholesteric LCD panel versus an evolution-time ratio.

FIG. 7 is a graph of the contrast of a cholesteric LCD panel versus an evolution-time ratio. Here, the evolution-time ratio indicates a ratio of the evolution time $T_{E2}$ shown in FIG. 3 to the selection time $T_{S2}$. In FIG. 7, a reference character C15*b* denotes the characteristic curve when an ambient temperature is 25° C. and the selection time $T_{S2}$ is 1.5 ms, and a reference character C11*b* denotes the characteristic curve when an ambient temperature is 30° C. and the selection time $T_{S2}$ is 1.1 ms. Referring to FIG. 7, the contrast can be enhanced when the evolution time $T_{E2}$ is 30–40 times longer than the selection time $T_{S2}$.

Figure 8:
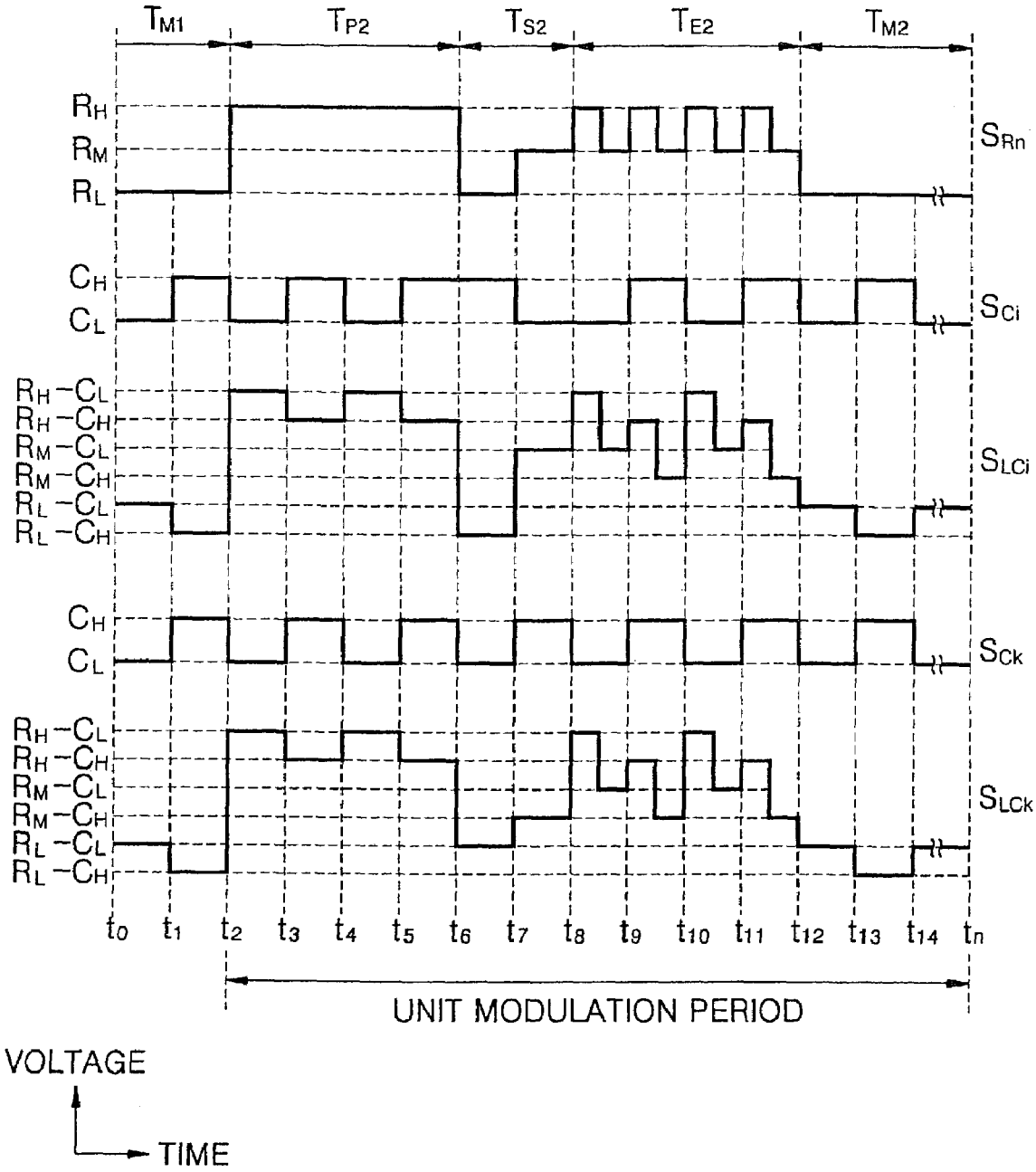
FIG. 8 is an entire timing diagram showing the waveforms of voltages which are applied to cholesteric liquid crystal cells that are turned on and cholesteric liquid crystal that are turned off according to the driving method shown in FIG. 3.

FIG. 8 is an entire timing diagram showing the waveforms of voltages which are applied to cholesteric liquid crystal cells that are turned on and cholesteric liquid crystal that are turned off according to the driving method shown in FIG. 3. In FIGS. 3, 4, and 8, the same reference characters denote the element having the same function. In FIG. 8, a reference character $S_{Ci}$ denotes a data signal applied to an i-th data electrode line that is turned on. A reference character $S_{LCi}$ denotes a liquid crystal cell that is turned on at the intersection between the n-th scan electrode line and the i-th data electrode line. A reference character $S_{Ck}$ denotes a data signal applied to k-th data electrode line that is turned off. A reference character $S_{LCk}$ denotes a liquid crystal cell that is turned off at the intersection between the n-th scan electrode line and the k-th data electrode line. A driving method using the waveforms shown in FIG. 8 is the same as that described in detail with reference with FIGS. 3 and 4, and thus description thereof will be omitted.

As described above, in a method of driving a cholesteric LCD panel according to the present invention, during the evolution time $T_{E2}$, the preparation line voltage $R_H$ and the high selection line voltage $R_M$ are alternately applied to the n-th scan electrode line so that RMS voltage of the two voltages $R_H$ and $R_M$, i.e., the fourth voltage $\sqrt{R_H^2+R_M^2}$, is applied to all cholesteric liquid crystal cells of the n-th scan electrode line. Accordingly, the number of output voltage levels of a scan-electrode driving device can be reduced to 3, thereby simplifying the internal circuit of the device and decreasing the manufacturing costs.

In addition, during the first and second part times t6–t7 and t7–t8 of the selection time $T_{S2}$, the selection line voltages $R_L$ and $R_M$ having different levels are applied while data signals in opposite logic states are applied. Accordingly, the applicable range of a driving voltage can be increased, and crosstalk can be minimized.

The present invention is not restricted to the above described preferred embodiments, and it will be understood by those skilled in the art that various changes in form and details maybe made therein without departing from the spirit and scope of the invention as defined by the appended claims.

What is claimed is:

1. A method of driving a cholesteric liquid crystal display panel, the method comprising:

applying in a preparation step a first voltage to all cholesteric liquid crystal cells of said cholesteric liquid crystal display panel accommodating all cholesteric liquid crystal cells changing into a homeotropic state;

applying in a selection step a second voltage lower than said first voltage to cholesteric liquid crystal cells that are turned on to accommodate the turned on cholesteric liquid crystal cells maintaining said homeotropic state, and a third voltage lower than said second voltage being applied to cholesteric liquid crystal cells that are turned off to accommodate the turned off cholesteric liquid crystal cells changing into a transient-planar state;

applying in an evolution step a fourth voltage, being lower than said first voltage and higher than said second voltage, to all cholesteric liquid crystal cells to accommodate said cholesteric liquid crystal cells that are turned on maintaining said homeotropic state, and said cholesteric liquid crystal cells that are turned off changing into a focal conic state, said first and second voltages being alternately applied in said evolution step to apply said fourth voltage, being given by a root-mean-square value of said first and second voltages, to all cholesteric liquid crystal cells; and applying said third voltage in a maintenance step to all cholesteric liquid crystal cells to accommodate said cholesteric liquid crystal cells that are turned on to change into a planar state, and said cholesteric liquid crystal cells that are turned off maintaining said focal conic state.

2. The method of claim 1, with said preparation step, said selection step, said evolution step, and said maintenance step being sequentially performed on each scan electrode line of said cholesteric liquid crystal display panel.

3. The method of claim 1, further comprised of a selection time during when said selection step is performed is divided into a first part time and a second part time, data signals are applied to all data electrode lines of said cholesteric liquid crystal display panel during said second part time, and signals in opposite logic states to the respective data signals are applied to all data electrode lines during said first part time.

4. The method of claim 3, further comprised of:

during said first part time, applying said third voltage to a particular electrode line, and simultaneously a data voltage being higher than said third voltage and lower than second voltage being applied to data electrode lines that are turned on, and said third voltage being applied to data electrode lines that are turned off; and during said second part time, applying said second voltage to the particular scan electrode line, and simultaneously said third voltage being applied to the data electrode lines that are turned on, and said data voltage being higher than said third voltage and lower than second voltage is applied to data electrode lines that are turned off.

5. The method of claim 1, further comprised of a time during when said first and second voltages are applied to all cholesteric liquid crystal cells one by one in said evolution step being shorter than a selection time during when the selection step is performed.

6. The method of claim 5, further comprised of a time during when said first and second voltages are applied to all cholesteric liquid crystal cells one by one in the evolution step being half of said selection time.

7. A method, comprising:

applying a first voltage to a liquid crystal display to change all of a plurality of liquid crystal cells of said liquid crystal display into a homeotropic state;

applying a second voltage to said liquid crystal cells that are turned on to accommodate the turned on liquid crystal cells maintaining said homeotropic state, and a third voltage lower than said second voltage being applied to liquid crystal cells that are turned off to accommodate the turned off liquid crystal cells changing into a transient-planar state, said second voltage being lower than said first voltage; and applying said first and second voltages alternately over a first period of time to all liquid crystal cells to accommodate said cholesteric liquid crystal cells that are turned on maintaining said homeotropic state, and said cholesteric liquid crystal cells that are turned off changing into a focal conic state.

8. The method of claim 7, further comprising of applying said third voltage to all liquid crystal cells to accommodate said liquid crystal cells that are turned on to change into a planar state, and said liquid crystal cells that are turned off maintaining said focal conic state.

9. The method of claim 8, said liquid crystal cells being cholesteric liquid crystal cells.

10. The method claim 7, said step of applying said second voltage being performed during a second period of time, said step of applying said second voltage further comprising:

applying signals in opposite logic states to respective data signals to all data electrode lines of said liquid crystal display panel during a first portion of said second period of time; and applying the data signals to all data electrode lines of said liquid crystal display panel during a second portion of said second period of time.

11. The method claim 8, said step of applying said second voltage being performed during a second period of time, said step of applying said second voltage further comprising:

applying signals in opposite logic states to respective data signals to all data electrode lines of said liquid crystal display panel during a first portion of said second period of time; and applying the data signals to all data electrode lines of said liquid crystal display panel during a second portion of said second period of time.

12. The method of claim 10, further comprised of:

during said second period of time, applying said third voltage to a particular electrode line, and simultaneously a data voltage being higher than said third voltage and lower than second voltage being applied to data electrode lines that are turned on, and said third voltage being applied to data electrode lines that are turned off; and during said second period of time, applying said second voltage to the particular scan electrode line, and simultaneously said third voltage being applied to the data electrode lines that are turned on, and said data voltage being higher than said third voltage and lower than second voltage is applied to data electrode lines that are turned off.

13. The method of claim 11, further comprised of during said second period of time, applying said third voltage to a particular electrode line, and simultaneously a data voltage being higher than said third voltage and lower than second voltage being applied to data electrode lines that are turned on, and said third voltage being applied to data electrode lines that are turned off; and during said second period of time, applying said second voltage to the particular scan electrode line, and simultaneously said third voltage being applied to the data electrode lines that are turned on, and said data voltage being higher than said third voltage and lower than second voltage is applied to data electrode lines that are turned off.

14. The method of claim 7, said step of applying said second voltage further comprising data signals being applied to all data electrode lines together with signals in opposite logic states to the data signals.

15. The method of claim 7, with a value of said first and second voltages alternately applied being a root mean square of said first voltage and said second voltage.

16. The method of claim 7, with a root mean square of said first and second voltages applied alternately over the period of time being lower than said first voltage and higher than said second voltage.

17. The method of claim 10, further comprised of said first period of time during when said first and second voltages are applied to all liquid crystal cells one by one in said step of applying said first and second voltages alternately over said first period of time, being shorter than said second period of time during said step of applying said second voltage.

18. The method of claim 17, further comprised of said first period of time during when said first and second voltages are applied to all liquid crystal cells one by one being half of said second period of time.

19. The method of claim 10, further comprised of said first period of time during when said first and second voltages are applied to all liquid crystal cells one by one being half of said second period of time.

* * * * *